United States Patent [19]

Polanschütz et al.

[11] Patent Number: 4,691,757

[45] Date of Patent: Sep. 8, 1987

[54] ARRANGEMENT PROVIDED AT A CONTINUOUS CASTING PLANT

[75] Inventors: Wolfgang Polanschütz; Luzian Pochmarski; Alfred Moser, all of Leoben, Austria

[73] Assignee: Voest-Alpine Aktiengesellschaft, Linz, Austria

[21] Appl. No.: 901,995

[22] Filed: Aug. 28, 1986

Related U.S. Application Data

[63] Continuation of Ser. No. 728,301, Apr. 29, 1985, abandoned.

[30] Foreign Application Priority Data

May 10, 1984 [AT] Austria ..... 1537/84

[51] Int. Cl.[4] ..... B22D 11/04

[52] U.S. Cl. ..... 164/416; 164/478; 248/638

[58] Field of Search ..... 164/416, 478, 501, 260, 164/71-81; 248/638

[56] References Cited

U.S. PATENT DOCUMENTS

| | | | |
|---|---|---|---|
| 2,815,551 | 12/1957 | Hessenberg et al. | 164/260 |
| 3,075,264 | 1/1963 | Wognum | 164/416 |
| 3,386,494 | 6/1968 | Yearley et al. | 164/260 |
| 3,469,809 | 9/1969 | Reznick et al. | 248/638 |
| 3,486,550 | 12/1969 | Yearly | 164/416 |
| 3,565,158 | 2/1971 | Ciochetto | 164/273 |
| 3,794,105 | 2/1974 | Voss | 164/416 |
| 4,239,078 | 12/1980 | Tarmann | 164/147 |
| 4,460,034 | 7/1984 | Saeki et al. | 164/416 |
| 4,483,385 | 11/1984 | Kurzinski | 164/416 |

FOREIGN PATENT DOCUMENTS

| | | | |
|---|---|---|---|
| 366607 | 9/1981 | Austria . | |
| 42437 | 12/1981 | European Pat. Off. . | |
| 3047652 | 9/1981 | Fed. Rep. of Germany . | |
| 1031135 | 6/1953 | France . | |
| 5486432 | 12/1977 | Japan . | |
| 2108878 | 5/1983 | United Kingdom | 164/478 |

OTHER PUBLICATIONS

"Handbuch des Stranggiessens", by Erhard Herrmann, Aluminium-Verlag GmbH, Dusseldorf, Germany.

*Primary Examiner*—Nicholas P. Godici
*Assistant Examiner*—Samuel M. Heinrich
*Attorney, Agent, or Firm*—Kurt Kelman

[57] ABSTRACT

To increase the effective acoustic capacity and to enable the mold side walls to be conventionally designed, a continuous casting plant comprising a stationary supporting structure and a continuous casting mold supported on the structure has its ultrasonic transducers fastened at one end to the stationary supporting structure and at the other end to the continuous casting mold.

10 Claims, 3 Drawing Figures

ARRANGEMENT PROVIDED AT A CONTINUOUS CASTING PLANT

This application is a continuation of application Ser. No. 728,301, filed Apr. 29, 1985, now abandoned.

The invention relates to a continuous casting plant comprising a continuous casting mold suspended or supported on a stationary supporting structure and an ultrasonic transducer.

The disposition of ultrasonic transducers for the purpose of causing the mold side walls to vibrate is known from German Pat. No. 30 47 652 and from European Pat. application No. 0 042 437. With these known arrangements, ultrasonic vibrators are fastened to the outer surfaces of the side walls. The vibration waves applied perpendicularly to the side walls are diverted into the longitudinal direction of the mold cavity, thus causing the side walls to vibrate in the axial direction, i.e., in the extraction direction of the strand. With the known molds, air gaps are required between the mold side walls or between parts of the mold side walls in order to enable vibrations of the mold side walls with respect to the mold frame, on which the side walls are mounted, which involves a special and expensive design of the mold side walls. This divided design of the mold walls furthermore calls for a complex sealing in the region of the meniscus, or in the region of the tear-off ring in the case of horizontal continuous casting plants in order to prevent the penetration of steel melt into the air gaps. With the known molds, the mold frames carrying the mold side walls are complex in design, their manufacture thus involving much work and time.

Since the sound introduction, with the known molds, is effected through the mold wall and a deviation of the trasmitted vibration wave by 90° is necessary, the effective acoustic capacity is reduced. Another disadvantage is that the application to tube molds is out of the question.

The invention aims at avoiding these disadvantages and difficulties and has as its object to provide an arrangement of the initially defined kind, in which the mold side walls may be designed in a conventional manner, i.e., as in conventional plate molds or in conventional tube molds. Furthermore, the efficiency, i.e., the effective acoustic capacity is increased, losses being largely avoided.

This object is achieved according to the invention by fastening one end of at least one ultrasonic transducer to the continuous casting mold and the other end to the stationary supporting structure. Thus, the mold is supported on the stationary supporting structure by the intermediate arrangement of an ultrasonic transducer, preferably a magnetostrictive vibrator, i.e., the mold is mechanically connected with the stationary supporting structure by means of at least one ultrasonic transducer.

Advantageously, an antivibration means is arranged between the ultrasonic transducer and the stationary supporting structure in order to prevent the transmission of vibrations onto the stationary supporting structure.

According to a preferred embodiment, the introduction of sound is effected by an ultrasonic transducer designed as a mold-carrying part, in the direction of the longitudinal axis of the mold cavity of the continuous casting mold.

Suitably, brackets are mounted on the stationary supporting structure, which partially cover the continuous casting mold, as seen in a top view in the direction of the longitudinal axis of the mold cavity. The continuous casting mold is suspended on the brackets by means of the ultrasonic transducers.

Furthermore, according to another embodiment, brackets may be provided on the continuous casting mold, which partially cover the stationary supporting structure, as seen in a top view in the direction of the longitudinal axis of the mold cavity. The ultrasonic transducers are arranged between these brackets and the stationary supporting structure, the ultrasonic transducers thereby being compressively stressed by the mold on account of its weight.

Suitably, the ultrasonic transducers are each articulately fastened to the brackets mounted on the supporting structure and to the continuous casting mold, or to the brackets provided on the continuous casting mold and to the stationary supporting structure.

According to a preferred embodiment, the sound introduction is effected transversely to the longitudinal axis of the mold cavity and at a lateral distance from the longitudinal axis, the mold thereby being set into torsional vibrations. The mold weight, with vertical continuous casting molds, in this case may be carried by elastic supports, for instance, by springs.

According to a preferred embodiment, the sound introduction is effected both in the direction of the longitudinal axis and transversely to the longitudinal axis of the mold cavity, whereby the mold is caused to vibrate both in the longitudinal direction and in the peripheral direction.

The invention will now be explained in more detail by way of three embodiments and with reference to the accompanying drawings, wherein.

Figure 1:
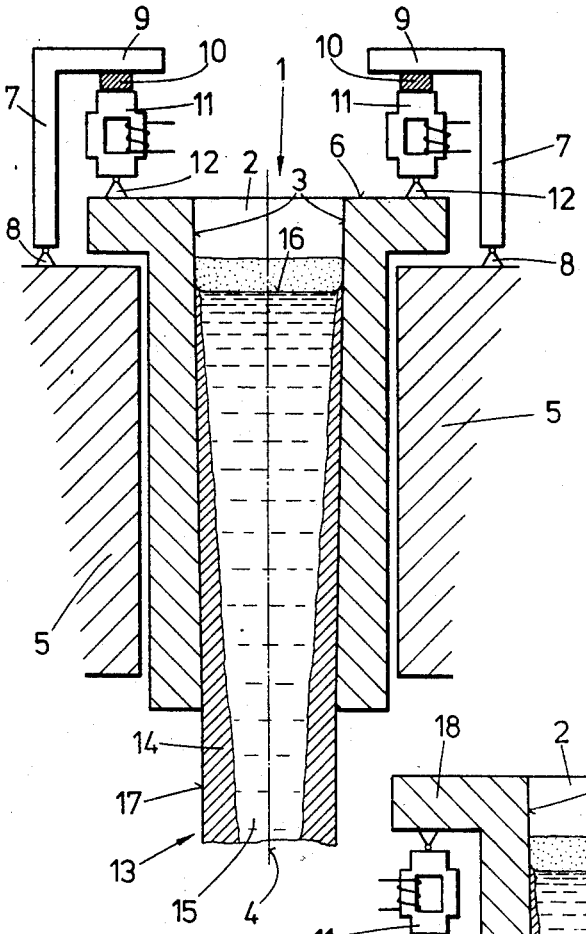
FIG. 1 is a schematically illustrated vertical section through a vertical continuous casting mold according to a first embodiment.

A mold 1 is comprised of side walls 3 delimiting a mold cavity 2 and of a carrying frame supporting the side walls 3, which, however, is not illustrated because the side walls 3 and the carrying frame constitute a structural unit to be commonly installed into, and removed from, a continuous casting plant. Molds of this type are described, for instance, in Austrian Pat. No. 366,607 for plate molds and in U.S. Pat. No. 4,239,078 for tube molds. Mold 1 may be designed as a plate mold or as a tube mold. The longitudinal axis 4 of the mold cavity 2 is vertically arranged.

Brackets 7 are mounted on a stationary supporting structure 5 peripherally surrounding the mold 1, which may be formed by the casting floor. Brackets 7 overlap the upper rim 6 of the mold 1, i.e., partially cover the rim 6, as seen in a top view in the direction of longitudinal axis 4. The brackets are preferably articulately fastened to the stationary supporting structure 5 by means of fixed bearings 8. Ultrasonic transducers 11 are fastened to parts 9 of the brackets, that overlap the upper rim 6 of the mold 1, and an antivibration means 10 is interposed between bracket part 9 and the ultrasonic transducer. With their opposite ends, these ultrasonic transducers 11, preferably magnetostrictive vibrators, are articulately fastened to the mold 1 by means of articulation bearings 12 such that the mold 1 is suspended from the ultrasonic transducers 11, whose number is chosen in accordance with the mold weight, the strand cross section, the oscillation amplitude desired, etc.

The strand 13 extracted from the mold, whose skin is denoted by 14, whose liquid core is denoted by 15 and whose miniscus is denoted by 16, is easily extractable from the mold 1 reciprocating at a frequency of at least 16 kHz, no oscillation marks being recognizable on the strand surface 17. The adherence of the strand skin 14 to the side walls 3 of the mold thereby is effectively prevented. Antivibration means 10 prevent the vibrations of the ultrasonic transducers 11 from being transmitted to the stationary supporting structure 5.

Figure 2:
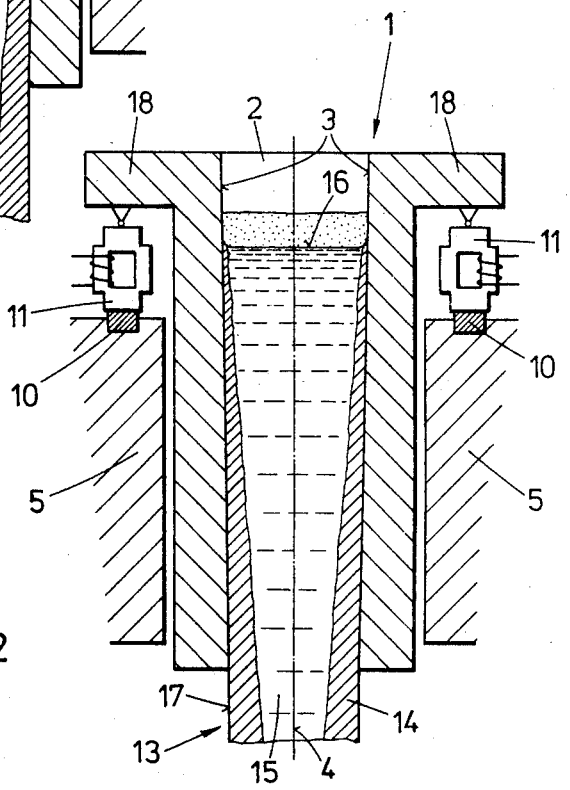
FIG. 2 is an illustration of a further embodiment, analogous to FIG. 1.

The embodiment illustrated in FIG. 2 differs from that of FIG. 1 in that the ultrasonic transducers 11 are arranged between brackets 18 cantilevering from the mold 1 and projecting over the stationary supporting structure 5, and the stationary supporting structure 5. In this case, the ultrasonic transducers 11 likewisely are articulately fastened to the brackets 18 of the mold 1 and antivibration means 10 are provided between the ultrasonic transducers and the stationary supporting structure 5.

Figure 3:
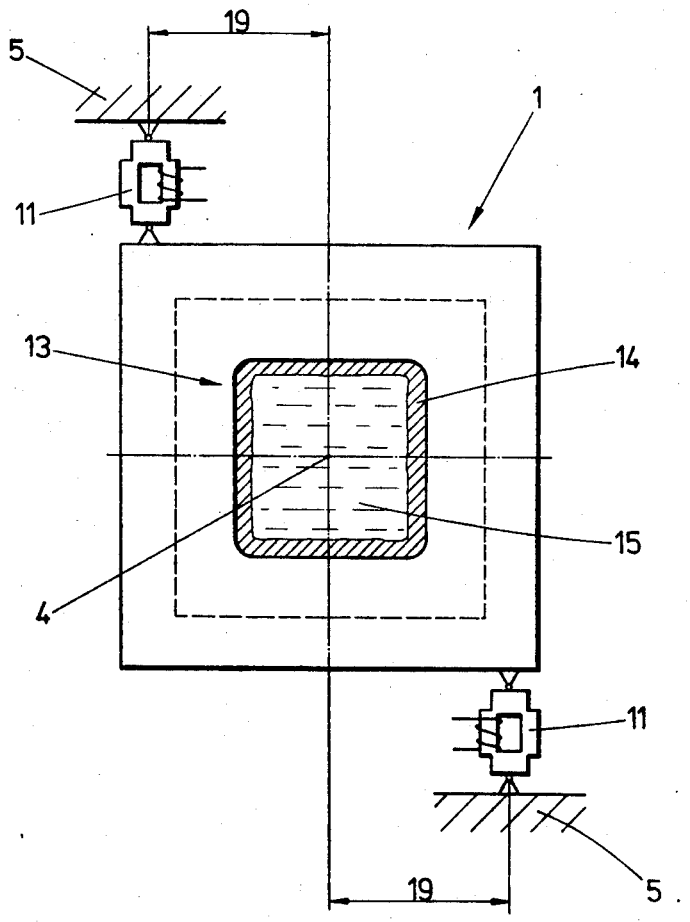
FIG. 3 illustrates a third embodiment, with the mold being set in torsional vibrations.

In FIG. 3, a further embodiment is illustrated, in which the mold 1 is subjected to torsional vibrations, i.e., vibrations transverse to the longitudinal axis 4 of the mold cavity. For this purpose, the ends of at least two ultrasonic transducers 11, are hinged to diagonally opposite corner regions of the mold 1 at a distance 19 from the longitudinal axis 4 of the mold cavity and their other ends are articulately fastened to the stationary supporting structure 5, if desired, also with interposed antivibration means.

The invention is not limited to the embodiments illustrated, but may be modified in various aspects. It is, for instance, possible to use the arrangement of the invention also with horizontal continuous casters. Furthermore, it may be advantageous to combine the embodiment illustrated in FIGS. 1 or 2 with the embodiment illustrated in FIG. 3; a mold equipped in this manner is subjected not only to longitudinal vibrations, but also to torsional vibrations.

What we claim is:

1. A continuous casting plant comprising a stationary supporting structure, a continous casting mold defining a mold cavity having a longitudinal axis supported on the structure, antivibration means fastened to the stationary supporting structure and an ultrasonic transducer having two ends, one end of the ultrasonic transducer being fastened to the antivibration means and the other end of the ultrasonic transducer being fastened to the continuous casting mold, thereby supporting said mold and being arranged to transmit ultrasound waves to the entire casting mold in the direction of the longitudinal axis of said mold cavity.

2. The continuous casting plant of claim 1, further comprising brackets mounted on the stationary supporting structure, the brackets having parts partially covering the continuous casting mold, as seen in a top view in the direction of the longitudinal axis, and a plurality of said ultrasonic transducers suspending the mold from the bracket parts.

3. The continuous casting plant of claim 2, wherein the other ends of the ultrasonic transducers are articulately fastened to the mold and the brackets are articulately fastened to the stationary supporting structure.

4. The continuous casting plant of claim 1, further comprising brackets provided on the continuous casting mold and partially covering the stationary supporting structure, as seen in a top view in the direction of the longitudinal axis, and a plurality of said ultrasonic transducers being arranged between the supporting structure and the brackets, the transducers carrying the mold on the supporting structure.

5. The continuous casting plant of claim 4, wherein the other ends of the ultrasonic transducers are articulately fastened to the mold.

6. A continuous casting plant comprising a stationary supporting structure, a continuous casting mold supported on the structure, antivibration means fastened to the stationary supporting structure and an ultrasonic transducer having two ends, one end of the ultrasonic transducer being fastened to the antivibration means and the other end of the ultrasonic transducer being fastened to the continuous casting mold, wherein the continuous casting mold defines a mold cavity having a longitudinal axis, and the ultrasonic transducer is arranged to carry the mold and to transmit ultrasound waves to the mold in the direction of the longitudinal axis of the mold cavity.

7. A continuous casting plant comprising a continuous casting mold defining a mold cavity having a longitudinal axis, a stationary supporting structure, brackets articulately fastened to said stationary supporting structure having parts partially covering said continuous casting mold, as seen in a top view in the direction of the longitudinal axis thereof, antivibration means fastened to said parts of said brackets and a plurality of ultrasonic transducers each having two ends, one end of said ultrasonic transducers being fastened to said antivibration means and the other end of said ultrasonic transducers being articulately fastened to the continuous casting mold thereby suspending said mold from said bracket parts, whereby said ultrasonic transducers are arranged to carry the mold and to transmit ultrasound waves to the mold in the direction of the longitudinal axis of the mold cavity.

8. The continuous casting plant of claim 7, wherein said continuous casting mold has an upper outwardly-extending rim, and said brackets each has a generally inverted L-shaped cross section and defines an upper, inwardly-extending leg which is spaced above and overlaps said rim and a lower, downwardly-extending leg, the end of which is articulately fastened to said supporting structure and wherein each of said transducers are arranged between said upper leg and said rim such that they are articulately fastened to said upper rim and connected via said antivibration means to said upper leg of said brackets.

9. A continuous casting plant comprising a continuous casting mold having an upper outwardly extending rim, a stationary supporting structure which at least partially underlies and is spaced from said rim of said continuous casting mold, antivibration means fastened to said stationary supporting structure at positions generally beneath said rim of said continuous casting mold, and a plurality of ultrasonic transducers each having two ends, one end of said ultrasonic transducers being fastened to said antivibration means and the other end of the ultrasonic transducers being articulately fastened underneath said rim of said continuous casting mold, whereby said casting mold is supported and suspended from said supporting structure, and wherein the continuous casting mold defines a mold cavity having a longitudinal axis, and the ultrasonic transducers are arranged to transmit ultrasonic waves to the mold in the direction of the longitudinal axis of the mold cavity.

10. The continuous casting plant of claim 7, wherein at least two ultrasonic transducers are hinged to diagonally opposite corner regions of said mold at a distance from the longitudinal axis of the mold cavity and are articulately fastened to the stationary supporting structure, thereby subjecting said mold to tortional vibrations and transmitting ultrasound waves to the mold transversely to the direction of the longitudinal axis of the mold cavity.

* * * * *